US008220400B2

(12) United States Patent
Ganga et al.

(10) Patent No.: US 8,220,400 B2
(45) Date of Patent: Jul. 17, 2012

(54) PROCESS FOR EFFICIENT ENERGY RECOVERY FROM BIOMASS

(75) Inventors: Raymond C. Ganga, Stone Mountain, GA (US); Greg Imig, Suwanee, GA (US); Blake McBurney, Alpharetta, GA (US); Robert Jansen, Portela (PT); John Kerr, South Croydon (GB); Steven J. Reust, Lafayette, IN (US)

(73) Assignee: European Sugar Holdings S.A.R.L., Capellen (LU)

( * ) Notice: Subject to any disclaimer, the term of this patent is extended or adjusted under 35 U.S.C. 154(b) by 859 days.

(21) Appl. No.: 12/173,247

(22) Filed: Jul. 15, 2008

(65) Prior Publication Data

US 2009/0044737 A1 Feb. 19, 2009

Related U.S. Application Data

(60) Provisional application No. 60/953,786, filed on Aug. 3, 2007.

(51) Int. Cl.
*F23D 1/00* (2006.01)
*F23B 80/02* (2006.01)
*F23C 9/08* (2006.01)

(52) U.S. Cl. ..... 110/347; 110/204; 110/261; 110/263

(58) Field of Classification Search ..... 110/196, 110/197, 203, 204, 216, 235, 252, 346, 215, 110/261, 262, 263, 265, 266
See application file for complete search history.

(56) References Cited

U.S. PATENT DOCUMENTS 4,509,326 A 4/1985 Jörgensen ..... 60/39.182
(Continued)

FOREIGN PATENT DOCUMENTS

EP 1 434 003 A2 6/2004
FR 2 673 702 9/1992
FR 2 761 458 10/1998
(Continued)

OTHER PUBLICATIONS

PCT/US2008/070057 International Search Report (Apr. 15, 2009).
(Continued)

*Primary Examiner* — Kenneth Rinehart
*Assistant Examiner* — David J Laux
(74) *Attorney, Agent, or Firm* — Williams, Morgan & Amerson, P.C.

(57) ABSTRACT

A method for extracting energy from biomass depleted of at least some carbohydrate, at least some oil, or both by a) introducing the biomass into a vertically elongated combustion chamber having i) at least one suspension burner at the top of the combustion chamber which is capable of projecting a flame down the axis of the combustion chamber, ii) a heat transfer apparatus having at least a portion of a heat collection surface located radially from the flame and below the burner, and iii) an exhaust opening located below the flame and below at least a portion of the heat collection surface; b) combusting the biomass to yield a mixture containing hot flue gas and molten ash above the exhaust opening; c) transferring heat from the hot flue gas to at least a portion of the heat collection surface substantially by radiation prior to any substantial contact of ash to a surface of the combustion chamber, to yield a mixture containing warm flue gas and non-molten ash and having a lower molten ash content than the mixture yielded by the combusting step; and d) cooling the warm flue gas with cold gas, to yield a mixture containing cool flue gas and non-molten ash and having a lower molten ash content than the mixture yielded by the transferring step.

16 Claims, 1 Drawing Sheet

U.S. PATENT DOCUMENTS

| | | | | |
|---|---|---|---|---|
| 4,525,172 | A * | 6/1985 | Eriksson | 110/263 |
| 4,616,572 | A * | 10/1986 | Berthiller | 110/254 |
| 5,165,903 | A | 11/1992 | Hunt et al. | 423/239 |
| 5,189,964 | A | 3/1993 | Rich, Jr. | 110/347 |
| 5,291,841 | A * | 3/1994 | Dykema | 110/347 |
| 5,406,914 | A | 4/1995 | Hyppanen | 122/4 D |
| 5,501,160 | A | 3/1996 | Goldman et al. | 110/229 |
| 5,590,610 | A | 1/1997 | Sanbonmatsu | 110/234 |
| 6,058,855 | A * | 5/2000 | Ake et al. | 110/214 |
| 6,202,574 | B1 * | 3/2001 | Liljedahl et al. | 110/233 |
| 6,615,751 | B1 | 9/2003 | Sørensen et al. | 110/343 |
| 7,007,616 | B2 | 3/2006 | Abrams et al. | 110/342 |
| 7,077,069 | B2 * | 7/2006 | Oomura et al. | 110/348 |
| 7,806,090 | B2 * | 10/2010 | McBurney et al. | 110/342 |
| 2004/0134395 | A1 | 7/2004 | Eberhardt et al. | 110/341 |
| 2007/0020375 | A1 | 1/2007 | Jansen et al. | 426/622 |
| 2009/0031934 | A1 | 2/2009 | Ganga et al. | 110/346 |

FOREIGN PATENT DOCUMENTS

| | | |
|---|---|---|
| FR | 2 795 161 | 12/2000 |
| JP | 2002/155287 | 5/2002 |
| JP | 2004/205161 | 7/2004 |
| JP | 2006/132811 | 5/2006 |
| WO | WO98/44297 | 10/1998 |

OTHER PUBLICATIONS

McBurney Project File: "Large Scale Wood Waste Fired Power Generating Plant," The McBurney Corporation, P.O. Box 1827, Norcross, GA 30091 (Mar. 1998).

McBurney Project File: "Wood Fired Steam Plant Provides Thermal Energy for Specialty Basket Manufacturer," The McBurney Corporation, P.O. Box 1827, Norcross, GA 30091 (Mar. 1998).

McBurney Project File: "Wood Fired Steam Plant Provides Thermal Energy for Romanian Sawmill," The McBurney Corporation, P.O. Box 1827, Norcross, GA 30091 (Mar. 1998).

Engineering Services, McBurney brochure, The McBurney Corporation, P.O. Box 1827, Norcross, GA 30091 (prior to Aug. 3, 2007).

Construction Services, McBurney brochure, The McBurney Corporation, P.O. Box 1827, Norcross, GA 30091 (prior to Aug. 3, 2007).

Maintenance & Repair, McBurney brochure, The McBurney Corporation, P.O. Box 1827, Norcross, GA 30091 (prior to Aug. 3, 2007).

McBurney Field Services, McBurney brochure, The McBurney Corporation, P.O. Box 1827, Norcross, GA 30091 (prior to Aug. 3, 2007).

McBurney Energy Systems, Modul-Pak II Boiler, McBurney brochure, The McBurney Corporation, P.O. Box 1827, Norcross, GA 30091 (for purposes of citation, prior to Aug. 3, 2007).

Modul-Pak brochure, Industrial Boiler Co., Inc., P.O. Drawer 2258, Thomasville, GA 31799 (for purposes of citation, prior to Aug. 3, 2007).

PCT/US2008/070067 International Search Report (Oct. 6, 2010).

Larsen et al., "Relations Between Combustion, Deposition, Flue Gas Temperatures and Corrosion in Straw-Fired Boilers," *2nd World Conference on Biomass for Energy, Industry and Climate Protection,* Rome, Italy (May 10-14, 2004).

* cited by examiner

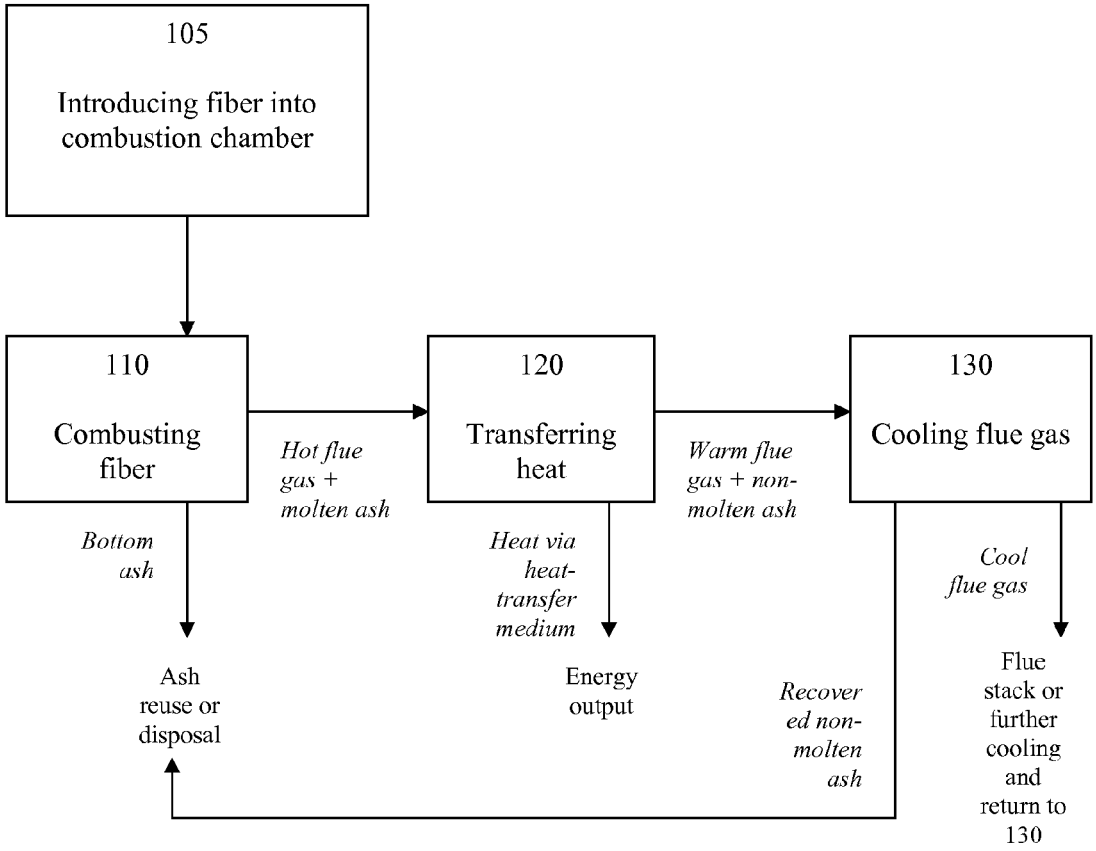
105
Introducing fiber into combustion chamber
110
Combusting fiber
Hot flue gas + molten ash
120
Transferring heat
Warm flue gas + non-molten ash
130
Cooling flue gas
Bottom ash
Ash reuse or disposal
Heat via heat-transfer medium
Energy output
Recovered non-molten ash
Cool flue gas
Flue stack or further cooling and return to 130

PROCESS FOR EFFICIENT ENERGY RECOVERY FROM BIOMASS

This application claims priority from U.S. provisional patent application Ser. No. 60/953,786, filed on Aug. 3, 2007, which is incorporated herein by reference.

STATEMENT REGARDING JOINT RESEARCH AGREEMENT

The claimed invention was made by or on behalf of The McBurney Corporation and Tate & Lyle Ingredients Americas, Inc., as parties to a joint research agreement that was in effect on or before the date the claimed invention was made as a result of activities undertaken within the scope of the joint research agreement.

BACKGROUND OF THE INVENTION

The present invention relates generally to the field of energy extraction from biomass. More particularly, it concerns energy extraction from plant biomass, such as plant fiber produced in grain, cane, and beet milling.

Biomass depleted of at least some carbohydrate, at least some oil, or both is used herein to refer to any material derived from a member of the plant kingdom and that has been physically separated from the plant and at least partially depleted (i.e., to less than about 40% d.s.b. total) of carbohydrate (sugars or starch) or oil (such as an oil-containing tissue, e.g., germ). An example of such biomass depleted of at least some carbohydrate, at least some oil, or both is fiber, defined herein as a material containing at least about 80 wt % d.s.b. of materials selected from the group consisting of non-starch polysaccharides, cellulose, hemicelluloses, dextrins, inulin, lignin, waxes, chitins, pectins, beta-glucans, oligosaccharides, and mixtures thereof. Other separated biomass includes, but is not limited to, such constituents as husk, hull, nutshells, leaves, stems, trunks, stalks, branches, or roots, among others. Biomass can be burned to provide energy; depending on the plant source, the biomass's composition, and its water content, it typically has a Higher Heating Value (HHV) of about 7000-10,000 BTU/lb (dry basis). Other plant materials, such as corn germ, can have HHVs as high as 15,000 BTU/lb (dry basis). Therefore, theoretically, biomass depleted of at least some carbohydrate, at least some oil, or both could be burned to wholly or partially power industrial processes, such as a milling process which produces fiber as a coproduct.

However, biomass depleted of at least some carbohydrate, at least some oil, or both has generally not been used as an energy source for a number of reasons. First, most biomass depleted of at least some carbohydrate, at least some oil, or both contains relatively high levels of ash (inorganic ions), such as phosphorous, calcium, magnesium, sodium, and potassium. For example, typical corn kernel fiber contains about 4% d.s.b. ash, of which phosphorous, either in elemental form or in compounds, is the most common element (total ash containing about 40 wt % $P_2O_5$). Fiber ash generally has a relatively low fusion or melting point, meaning that at higher temperatures the ash is molten and will form slag on refractory or metallic surfaces of a furnace, boiler, or flue gas stack if the molten ash contacts these surfaces. Ash at temperatures below its melting point is generally in the form of small, irregularly shaped, solid particles.

Another concern regarding combustion of biomass depleted of at least some carbohydrate, at least some oil, or both is fuel-bound nitrogen. Biomass depleted of at least some carbohydrate, at least some oil, or both typically contains some residual proteins, which contain nitrogen. Combustion in air or under another oxygenated atmosphere of a fuel containing nitrogen will lead to formation of nitrogen oxides (NOx). NOx emissions are generally discouraged under the regulatory climates prevailing in the developed world. NOx emissions can be at least partially reduced by good combustion practice. Further reduction of NOx can be achieved by scrubbing flue gas by various known means, but these involve further expenses for equipment, maintenance, and operations.

Therefore, it would be desirable to have a method for extracting energy from biomass depleted of at least some carbohydrate, at least some oil, or both that has a minimal risk of slagging and relatively low NOx emissions.

SUMMARY OF THE INVENTION

In one embodiment, the present invention relates to a method for extracting energy from biomass depleted of at least some carbohydrate, at least some oil, or both by a) introducing the biomass into a vertically elongated combustion chamber having i) at least one suspension burner at the top of the combustion chamber which is capable of projecting a flame down the axis of the combustion chamber, ii) a heat transfer apparatus having at least a portion of a heat collection surface located radially from the flame and below the burner, and iii) an exhaust opening located below the flame and below at least a portion of the heat collection surface; b) combusting the biomass to yield a mixture containing hot flue gas and molten ash above the exhaust opening; c) transferring heat from the hot flue gas to at least a portion of the heat collection surface substantially by radiation prior to any substantial contact of ash to a surface of the combustion chamber, to yield a mixture containing warm flue gas and non-molten ash and having a lower molten ash content than the mixture yielded by the combusting step; and d) cooling the warm flue gas with cold gas, to yield a mixture containing cool flue gas and non-molten ash and having a lower molten ash content than the mixture yielded by the transferring step.

The present invention provides a method for extracting energy from biomass depleted of at least some carbohydrate, at least some oil, or both that has a minimal risk of slagging and relatively low NOx emissions.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 1 shows a flow chart of performance of the method.

DESCRIPTION OF ILLUSTRATIVE EMBODIMENTS

Turning to FIG. 1, in one embodiment, the present invention relates to a method for extracting energy from biomass depleted of at least some carbohydrate, at least some oil, or both, comprising 105 introducing the biomass into a vertically elongated combustion chamber having i) at least one suspension burner at the top of the combustion chamber which is capable of projecting a flame down the axis of the combustion chamber, ii) a heat transfer apparatus having at least a portion of a heat collection surface located radially from the flame and below the burner, and iii) an exhaust opening located below the flame and below at least a portion of the heat collection surface; 110 combusting the biomass to yield a mixture containing hot flue gas and molten ash above the exhaust opening; 120 transferring heat from the hot flue gas to at least a portion of the heat collection surface substantially by radiation prior to any substantial contact of ash to a surface of the combustion chamber, to yield a mixture containing warm flue gas and non-molten ash and having a lower molten ash content than the mixture yielded by the combusting step; and 130 cooling the warm flue gas with cold gas, to yield a mixture containing cool flue gas and non-molten ash and having a lower molten ash content than the mixture yielded by the transferring step.

Common sources of biomass depleted of at least some carbohydrate, at least some oil, or both include grains of corn, wheat, rice, and other cereals, and stalks, leaves, and other vegetative matter of grasses, shrubs, and trees, such as cane or beets. In one embodiment, the biomass is derived from corn kernels wet-milled according to the process described in copending U.S. patent application Ser. No. 11/185,527, filed Jul. 20, 2005, which is hereby incorporated by reference. Other processes for the milling of corn kernels or other grains are also known. The biomass can be ground to produce particles of a relatively small, relatively uniform particle size and dried to a relatively low moisture content prior to performance of the method by techniques known in the art.

The combustion chamber (which may also be referred to as a furnace) into which the biomass can be introduced 105 can be as described in a provisional patent application to McBurney, filed this same date, which is incorporated herein by reference. In one embodiment, the combustion chamber is modular, i.e., is assembled off-site and shipped to the site of its intended use. In another embodiment, the combustion chamber is field-assembled.

In the present invention, biomass is the fuel burned in the combustion chamber and the oxidant can be oxygen, generally provided in the form of air, an oxygen/nitrogen mixture, or purified oxygen. The oxidant need not be oxygen. Air is inexpensive and does not require special handling.

Typically, the biomass depleted of at least some carbohydrate, at least some oil, or both will contain some amount of nitrogen, primarily in any protein not extracted from the biomass between harvesting the plant and combustion of the biomass. Combustion of nitrogen-containing materials, using air or oxygen as the oxidant, will generate nitrogen oxides (NOx), such as nitric oxide and nitrous oxide, by reaction between nitrogen liberated from the material and oxygen. This is in addition to the generation of NOx by high-temperature reaction between nitrogen and oxygen both present in combustion air, if air is used as the oxidant. NOx emissions are undesirable under both custom and regulation in the developed world.

To bring about relatively low NOx production in combusting 110, in one embodiment, the combustion temperature can be from about 1500° C. to about 1800° C. Though some NOx is expected to form at these temperatures, it is generally less than the amount expected to form at either higher or lower temperatures. However, this temperature range presupposes relatively standard cereal grain fiber with a protein content of about 11% d.s.b. (corn fiber) to about 18% d.s.b. (wheat fiber) and a water content less than about 15 wt %.

In another embodiment, combustion is staged with substoichiometric levels of the oxidant (relative to the fuel) fed to the combustion chamber, leading to reduced formation of NOx and increased formation of $N_2$.

In addition to biomass depleted of at least some carbohydrate, at least some oil, or both and the oxidant, other materials can be added to the burner or the furnace during combustion. In one embodiment, the method further comprises adding a combustion additive into the flame or furnace during combusting. The combustion additive can be added at the tip of the flame so it is immediately ionized. A combustion additive is any material that enhances one or more properties of one or more combustion products.

In a further embodiment, the combustion additive is a material that modifies one or more properties of the ash, such as its melting point, which can minimize slagging. There are various examples of such materials under various trade names; an example of such material is Co-Mate® (Atlantic Combustion Technologies Inc., Amherst, NS).

In another embodiment, the method further comprises adding a NOx reducing agent into the flame during combusting. The NOx reducing agent can be any simple nitrogeneous compound, and in one embodiment the NOx reducing agent is selected from the group consisting of urea and ammonia. In one embodiment, adding the NOx reducing agent is performed when the furnace is at a temperature from about 925° C. to about 980° C., such as about 955° C. By doing so, NOx quantities in the warm flue gas can be reduced and NOx emissions lowered. The addition of a NOx reducing agent can be termed selective non-catalytic reduction (SNCR).

Although NOx emissions may be lowered by one or more of the techniques described above, some NOx may still be present in the flue gas and can be treated by a NOx abatement system (e.g., SNCR or SCR).

The combusting step 110 yields a hot flue gas, molten ash, and possibly bottom ash. (Molten ash may also be referred to as tacky ash. Bottom ash may also be referred to as non-molten ash or non-tacky ash). The bottom ash can be recovered for disposal or reuse, as will be discussed in more detail below. The hot flue gas contains energy which, if captured, could be used to power or partially power various processes, such as a grain milling process that produces fiber as a byproduct, for example, the grain milling process described in U.S. patent application Ser. No. 11/185,527, discussed above. In one embodiment, "hot" refers to a temperature in the range from about 300° C. greater than the fusion point of the ash to about the flame temperature. However, the molten ash, if it were to contact a metal surface within the firebox, a boiler, or other structures, would over time form a slag on that metal surface that would lead to corrosion (and subsequent downtime and expense for repair or replacement of corroded materials) and, if heat transfer were intended to occur across that metal surface, would reduce the efficiency of heat transfer.

In the transferring step 120, heat from the hot flue gas is transferred to at least a portion of a heat-transfer apparatus, such as a water wall (an area formed by pipes containing a heat-transfer medium, such as water), substantially by radiation prior to any contact of the molten ash to a surface of the combustion chamber, to yield a warm flue gas and a non-molten ash. "Warm" in this context refers to a temperature lower than that of the hot flue gas generated by combustion. In one embodiment, the warm flue gas is at a temperature from about the fusion point of the ash to about the melting point of the ash and below the combustion temperature. In one embodiment, the warm flue gas is at a temperature from about the fusion point of the ash to about 300° C. greater than the fusion point of the ash. In one embodiment, the warm flue gas is at a temperature in range from about 1200° C. to about 760° C. As is known, radiation involves infrared emission by molecules of a hotter material (in this case, the hot flue gas) and infrared absorption by molecules of a colder one (in this case, the outer wall(s) of the heat-transfer apparatus, which then conduct(s) heat to the heat-transfer medium flowing therein). A small amount of heat (typically, less than about 5% of the heat generated by the combusting step 110) can be transferred by conduction or convection. The heat-transfer medium can then be used to transfer heat to other apparatus which can convert heat to useful work, such as a steam heater or a turbine, among others. Contact of the molten ash to a surface of the combustion chamber, especially if such surface is made of metal, prior to radiative heat transfer would result in slagging and the undesirable effects discussed above. Another desirable outcome of heat transfer via radiation is the cooling of the hot flue gas (typically at a temperature from about 1500° C. to about 1800° C.) to a warm flue gas (typically at a temperature from about 760° C. to about 1200° C.), at which temperature a major portion of the ash is typically rendered non-molten. The non-molten ash is substantially inert with respect to metal and does not form a slag on interior surfaces of the firebox or other equipment. However, some molten ash may remain entrained in the warm flue gas after the transferring step 120. That said, the amount of molten ash entrained in the warm flue gas after the transferring step 120 will be less than the amount of molten ash entrained in the hot flue gas generated by the combusting step 110.

After heat transfer, the warm flue gas is cooled 130 with cold gas, to yield a mixture containing cool flue gas and non-molten ash and having a lower molten ash content than the mixture yielded by the transferring step. "Cool" in this context refers to a temperature lower than that of the warm flue gas but higher than that of the cold gas, such as from about the ash fusion temperature to about ambient temperature, typically from about the ash fusion temperature to about 650° C. The cold gas can be provided as flue gas returned from subsequent downstream processing. Other cold gas, such as ambient air, can be used. Cooling 130 further reduces the temperature of the warm flue gas and further increases the non-molten ash content relative to that yielded by the transferring step 120. In other words, the amount of molten ash entrained in the cool flue gas after the cooling step 130 will be less than the amount of molten ash entrained in the warm flue gas generated by the transferring step 120. In one embodiment, cooling 130 yields substantially no molten ash, i.e., substantially all ash is non-molten.

After cooling 130, other steps can be performed, if desired. Ash recovery can be performed using a dust collector, electrostatic precipitation, or a wet scrubber, among other techniques and apparatus. Non-molten ash generally contains phosphorous and may contain calcium, magnesium, sodium, or potassium. The non-molten ash can be discarded. To minimize disposal costs and maximize value, the non-molten ash can be reused as a fertilizer, a land filling material, or a component of a phosphatic cement or other valuable product, among other uses.

The exit temperature of the cool flue gas after primary heat recovery is typically about 650° C. (about 1200° F.). The cool flue gas may contain volatile chlorides and SOx. The cool flue gas can be vented to a flue stack or otherwise processed, such as by a second heat transfer step. In one embodiment, the cool flue gas undergoes a second cooling step to yield a cold flue gas that can be returned (in other words, a returned flue gas) for use as the cold gas in cooling step 130. In one embodiment, the cool flue gas can be used for drying non-dry cereal processing products (e.g., fiber or Corn Gluten Meal), if the temperature of the cool flue gas is in the required range for drying these types of products, typically 150° C. to 400° C. After drying, the exit gas can be "wet scrubbed" to remove residual volatile gases and fly ashes, thus removing volatile chlorides and SOx, if contained in the NOx abated gas, using the same standard equipment, to provide a cost effective way to achieve low emission levels of these volatiles. The exit gas, after drying and wet scrubbing, may be termed "cold flue gas."

In one embodiment, the warm flue gas has a temperature from about 760° C. to about 1200° C., the cool flue gas has a temperature from about 200° C. to about 650° C., and the cold gas has a temperature from about ambient temperature to about 600° C.

In one embodiment, a cool flue gas stream at about 340° C. may be used to preheat the air entering the combustion chamber. In another embodiment, the combustion chamber air can be preheated using other low temperature (e.g., 200° C.) waste gas streams which are recoverable from a cereal processing refinery. In one embodiment, the waste gas stream is a cold flue gas yielded by drying and wet scrubbing of cool flue gas.

This use of the NOx abated cool flue gas from the combustion chamber avoids the necessity for drying a cereal processing product using a gas stream that has been preheated using a specific energy source such as natural gas or other fossil fuels. The typical energy savings by the use of the approach outlined above would reduce the energy required for drying the cereal processing product by about 50% and would further reduce the carbon footprint of a cereal processing plant.

Returning to NOx abatement, in one embodiment, NOx in the flue gas can be quantified by techniques known in the art. This may be useful in complying with emissions regulations in various jurisdictions. In addition, quantifying NOx in the flue gas can provide information, either to the operator or a control device, to enable adjustment of the combustion temperature to reduce the quantity of NOx produced and thence subsequent NOx levels in the flue gas after heat transfer and cooling being routed to the flue stack or other further processing.

In one embodiment, the method further comprises scrubbing NOx from the flue gas. NOx scrubbing can be performed using techniques and apparatus known in the art for removing NOx from gas streams, such as selective catalytic reduction (SCR).

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

As will be known to a person skilled in the art, the analyses included in the following examples may vary depending on the conditions in the soil, air and water at the time the vegetation was grown, as well as the moisture content of the biomass fuel at the time the biomass fuel is used as an energy source.

EXAMPLES

Example 1

Whole wheat grain was dry milled and sieved to generate two product streams: flour and wheat fiber. Typical properties of the wheat fiber are summarized in Table 1. The wheat fiber was burned in a suspension burner and the heat was recovered. The exhaust gases were analysed and burn conditions could be achieved which would allow BACT (Best Available Control Technology) abatement methodologies to be used successfully on this material.

TABLE 1

| | Reporting Basis | | |
|---|---|---|---|
| | As Rec'd | Dry | Air Dry |
| Proximate (%) | | | |
| Moisture | 11.70 | 0.00 | 11.70 |
| Ash | 3.59 | 4.07 | 3.59 |
| Volatile | 68.24 | 77.28 | 68.24 |
| Fixed C | 16.47 | 18.65 | 16.47 |
| Total | 100.00 | 100.00 | 100.00 |
| Sulfur | 0.18 | 0.20 | 0.18 |
| Btu/lb (HHV) | 7401 | 8381 | 7401 |
| MMF Btu/lb | 7698 | 8766 | |
| MAF Btu/lb | | 8737 | |
| Ultimate (%) | | | |
| Moisture | 11.70 | 0.00 | 11.70 |
| Carbon | 42.28 | 47.88 | 42.28 |
| Hydrogen | 5.46 | 6.18 | 5.46 |
| Nitrogen | 2.56 | 2.90 | 2.56 |
| Sulfur | 0.18 | 0.20 | 0.18 |
| Ash | 3.59 | 4.07 | 3.59 |
| Oxygen* | 34.23 | 38.77 | 34.23 |
| Total | 100.00 | 100.00 | 100.00 |
| Chlorine | 0.052 | 0.059 | 0.052 |

Lb. Alkali/MM Btu = 1.52
Lb. Ash/MM Btu = 4.85
Lb. SO2/MM Btu = 0.49
*Oxygen by Difference.

Elemental Analysis of Ash (%)

| | |
|---|---|
| $SiO_2$ | 4.00 |
| $Al_2O_3$ | 0.08 |
| $TiO_2$ | 0.02 |
| $Fe_2O_3$ | 0.39 |
| CaO | 3.09 |
| MgO | 10.70 |
| $Na_2O$ | 0.25 |
| $K_2O$ | 31.10 |
| $P_2O_5$ | 45.54 |
| $SO_3$ | 0.91 |
| Cl | 0.04 |
| $CO_2$ | 0.43 |
| Total | 96.55 |

Ash Fusion Temperatures (Deg F.)

| | Oxidizing Atmosphere | Reducing Atmosphere |
|---|---|---|
| Initial | 1500 | 1597 |
| Softening | 1596 | 1652 |
| Hemispherical | 1626 | 1700 |
| Fluid | 1660 | 1735 |

Note:
The ash was calcined @ 1110° F. (600° C.) prior to analysis

Example 2

High carbohydrate corn fiber derived from normal corn wet milling process was burned in a suspension burner. Properties of the biomass boiler feed and the resulting ash are summarized in Table 2.

TABLE 2

| | Reporting Basis | | |
|---|---|---|---|
| | As Rec'd | Dry | Air Dry |
| Proximate (%) | | | |
| Moisture | 12.31 | 0.00 | 12.31 |
| Ash | 1.34 | 1.53 | 1.34 |
| Volatile | 69.79 | 79.59 | 69.79 |
| Fixed C | 16.56 | 18.88 | 16.56 |
| Total | 100.00 | 100.00 | 100.00 |
| Sulfur | 0.25 | 0.29 | 0.25 |
| Btu/lb (HHV) | 7389 | 8426 | 7389 |
| MMF Btu/lb | 7495 | 8567 | |
| MAF Btu/lb | | 8557 | |
| Ultimate (%) | | | |
| Moisture | 12.31 | 0.00 | 12.31 |
| Carbon | 43.39 | 49.48 | 43.39 |
| Hydrogen | 5.35 | 6.10 | 5.35 |
| Nitrogen | 1.93 | 2.20 | 1.93 |
| Sulfur | 0.25 | 0.29 | 0.25 |
| Ash | 1.34 | 1.53 | 1.34 |
| Oxygen* | 35.43 | 40.40 | 35.43 |
| Total | 100.00 | 100.00 | 100.00 |
| Chlorine | 0.039 | 0.044 | 0.039 |

Lb. Alkali/MM Btu = 0.55
Lb. Ash/MM Btu = 1.81
Lb. SO2/MM Btu = 0.68
*Oxygen by Difference.

Elemental Analysis of Ash (%)

| | |
|---|---|
| $SiO_2$ | 12.56 |
| $Al_2O_3$ | 3.22 |
| $TiO_2$ | 0.13 |
| $Fe_2O_3$ | 1.44 |
| CaO | 1.94 |
| MgO | 12.50 |
| $Na_2O$ | 1.65 |
| $K_2O$ | 28.50 |
| $P_2O_5$ | 31.64 |
| $SO_3$ | 5.37 |
| Cl | 0.21 |
| $CO_2$ | 0.54 |
| Total | 99.70 |

Ash Fusion Temperatures (Deg F.)

| | Oxidizing Atmosphere | Reducing Atmosphere |
|---|---|---|
| Initial | 2420 | 2258 |
| Softening | 2446 | 2292 |
| Hemispherical | 2469 | 2372 |
| Fluid | 2517 | 2456 |

Note:
The ash was calcined @ 1110° F. (600° C.) prior to analysis

Example 3

A low carbohydrate corn fiber produced as described in co-pending U.S. patent application Ser. No. 11/185,527 was burned in a suspension burner. Properties of the biomass boiler feed and the resulting ash are summarized in Table 3.

TABLE 3

| | Reporting Basis | | |
|---|---|---|---|
| | As Rec'd | Dry | Air Dry |
| Proximate (%) | | | |
| Moisture | 4.50 | 0.00 | 4.50 |
| Ash | 1.12 | 1.17 | 1.12 |
| Volatile | 75.82 | 79.39 | 75.82 |
| Fixed C | 18.56 | 19.44 | 18.56 |
| Total | 100.00 | 100.00 | 100.00 |
| Sulfur | 0.25 | 0.26 | 0.25 |
| Btu/lb (HHV) | 8332 | 8725 | 8332 |
| MMF Btu/lb | 8433 | 8836 | |
| MAF Btu/lb | | 8828 | |
| Ultimate (%) | | | |
| Moisture | 4.50 | 0.00 | 4.50 |
| Carbon | 48.29 | 50.57 | 48.29 |
| Hydrogen | 6.42 | 6.72 | 6.42 |
| Nitrogen | 1.70 | 1.78 | 1.70 |
| Sulfur | 0.25 | 0.26 | 0.25 |
| Ash | 1.12 | 1.17 | 1.12 |
| Oxygen* | 37.72 | 39.50 | 37.72 |
| Total | 100.00 | 100.00 | 100.00 |
| Chlorine | 0.067 | 0.070 | 0.067 |

Lb. Alkali/MM Btu = 0.51
Lb. Ash/MM Btu = 1.34
Lb. SO2/MM Btu = 0.60
*Oxygen by Difference.

Elemental Analysis of Ash (%)

| | |
|---|---|
| $SiO_2$ | 7.28 |
| $Al_2O_3$ | 0.65 |
| $TiO_2$ | 0.10 |
| $Fe_2O_3$ | 1.40 |
| CaO | 3.69 |
| MgO | 9.05 |
| $Na_2O$ | 26.10 |
| $K_2O$ | 11.60 |
| $P_2O_5$ | 28.33 |
| $SO_3$ | 11.00 |
| Cl | 2.39 |
| $CO_2$ | 0.22 |
| Total | 101.81 |

Ash Fusion Temperatures (Deg F.)

| | Oxidizing Atmosphere | Reducing Atmosphere |
|---|---|---|
| Initial | 1913 | 2618 |
| Softening | 1930 | 2638 |
| Hemispherical | 1946 | 2640 |
| Fluid | 1957 | 2645 |

Note:
The ash was calcined @ 1110° F. (600° C.) prior to analysis

Example 4

Whole dent corn was hammer milled to produce a finely ground feed. This feed was burned in a suspension burner. Properties of the biomass boiler feed and the resulting ash are summarized in Table 4.

TABLE 4

| | Reporting Basis | | |
|---|---|---|---|
| | As Rec'd | Dry | Air Dry |
| Proximate (%) | | | |
| Moisture | 12.67 | 0.00 | 12.67 |
| Ash | 1.78 | 2.04 | 1.78 |
| Volatile | 70.55 | 80.79 | 70.55 |
| Fixed C | 15.00 | 17.17 | 15.00 |
| Total | 100.00 | 100.00 | 100.00 |
| Sulfur | 0.10 | 0.11 | 0.10 |
| Btu/lb (HHV) | 7105 | 8135 | 7105 |
| MMF Btu/lb | 7243 | 8318 | |
| MAF Btu/lb | | 8305 | |
| Ultimate (%) | | | |
| Moisture | 12.67 | 0.00 | 12.67 |
| Carbon | 41.19 | 47.17 | 41.19 |
| Hydrogen | 5.45 | 6.24 | 5.45 |
| Nitrogen | 1.24 | 1.42 | 1.24 |
| Sulfur | 0.10 | 0.11 | 0.10 |
| Ash | 1.78 | 2.04 | 1.78 |
| Oxygen* | 37.57 | 43.02 | 37.57 |
| Total | 100.00 | 100.00 | 100.00 |
| Chlorine | 0.036 | 0.041 | 0.036 |

Lb. Alkali/MM Btu = 0.62
Lb. Ash/MM Btu = 2.51
Lb. SO2/MM Btu = 0.28
*Oxygen by Difference.

Elemental Analysis of Ash (%)

| | |
|---|---|
| $SiO_2$ | 3.67 |
| $Al_2O_3$ | 0.22 |
| $TiO_2$ | 0.04 |
| $Fe_2O_3$ | 0.33 |
| CaO | 15.20 |
| MgO | 9.88 |
| $Na_2O$ | 0.19 |
| $K_2O$ | 24.50 |
| $P_2O_5$ | 41.53 |
| $SO_3$ | 1.89 |
| Cl | 0.05 |
| $CO_2$ | 3.10 |
| Total | 100.60 |

Ash Fusion Temperatures (Deg F.)

| | Oxidizing Atmosphere | Reducing Atmosphere |
|---|---|---|
| Initial | 1963 | 2010 |
| Softening | 1979 | 2043 |
| Hemispherical | 1994 | 2085 |
| Fluid | 2017 | 2100 |

Note:
The ash was calcined @ 1110° F. (600° C.) prior to analysis

All of the methods disclosed and claimed herein can be made and executed without undue experimentation in light of the present disclosure. While the methods of this invention have been described in terms of preferred embodiments, it will be apparent to those of skill in the art that variations may be applied to the methods and in the steps or in the sequence of steps thereof described herein without departing from the concept, spirit and scope of the invention. All such similar substitutes and modifications apparent to those skilled in the art are deemed to be within the spirit, scope and concept of the invention as defined by the appended claims.

What is claimed is:

1. A method for extracting energy from biomass depleted of at least some carbohydrate, at least some oil, or both, comprising:

a) introducing the biomass into a vertically elongated combustion chamber having:

i) at least one suspension burner at the top of the combustion chamber which is capable of projecting a flame down the axis of the combustion chamber, ii) a heat transfer apparatus having at least a portion of a heat collection surface located radially from the flame and below the burner, and iii) an exhaust opening located below the flame and below at least a portion of the heat collection surface, wherein the combustion chamber is modular;

b) combusting the biomass to yield a mixture containing hot flue gas and molten ash above the exhaust opening;

c) transferring heat from the hot flue gas to at least a portion of the heat collection surface substantially by radiation prior to any substantial contact of ash to a surface of the combustion chamber, to yield a mixture containing warm flue gas and non-molten ash and having a lower molten ash content than the mixture yielded by the combusting step; and d) cooling the warm flue gas with cold gas, to yield a mixture containing cool flue gas and non-molten ash and having a lower molten ash content than the mixture yielded by the transferring step.

2. The method of claim 1, wherein the cold gas is returned flue gas.

3. The method of claim 1, wherein the combustion temperature is from about 1500° C. to about 1800° C.

4. The method of claim 1, wherein the warm flue gas has a temperature from about 760° C. to about 1200° C.

5. The method of claim 1, wherein the cool flue gas has a temperature less than about 650° C.

6. The method of claim 1, wherein the cold gas has a temperature less than about 600° C.

7. A method for extracting energy from biomass depleted of at least some carbohydrate, at least some oil, or both, comprising:

a) introducing the biomass into a vertically elongated combustion chamber having:

i) at least one suspension burner at the top of the combustion chamber which is capable of projecting a flame down the axis of the combustion chamber, ii) a heat transfer apparatus having at least a portion of a heat collection surface located radially from the flame and below the burner, and iii) an exhaust opening located below the flame and below at least a portion of the heat collection surface;

b) combusting the biomass to yield a mixture containing hot flue gas and molten ash above the exhaust opening;

c) transferring heat from the hot flue gas to at least a portion of the heat collection surface substantially by radiation prior to any substantial contact of ash to a surface of the combustion chamber, to yield a mixture containing warm flue gas and non-molten ash and having a lower molten ash content than the mixture yielded by the combusting step; and d) cooling the warm flue gas with cold gas, to yield a mixture containing cool flue gas and non-molten ash and having a lower molten ash content than the mixture yielded by the transferring step, further comprising quantifying NOx in the flue gas.

8. The method of claim 7, wherein the combustion temperature is adjusted to reduce the quantity of NOx in the flue gas.

9. The method of claim 7, further comprising adding a combustion additive into the flame during combusting.

10. The method of claim 9, wherein the combustion additive modifies at least one property of the ash.

11. The method of claim 7, further comprising adding a NOx reducing agent selected from the group consisting of simple nitrogeneous compounds.

12. The method of claim 11, further comprising adding a NOx reducing agent selected from the group consisting of urea and ammonia.

13. A method for extracting energy from biomass depleted of at least some carbohydrate, at least some oil, or both, comprising:

a) introducing the biomass into a vertically elongated combustion chamber having:

i) at least one suspension burner at the top of the combustion chamber which is capable of projecting a flame down the axis of the combustion chamber, ii) a heat transfer apparatus having at least a portion of a heat collection surface located radially from the flame and below the burner, and iii) an exhaust opening located below the flame and below at least a portion of the heat collection surface;

b) combusting the biomass to yield a mixture containing hot flue gas and molten ash above the exhaust opening;

c) transferring heat from the hot flue gas to at least a portion of the heat collection surface substantially by radiation prior to any substantial contact of ash to a surface of the combustion chamber, to yield a mixture containing warm flue gas and non-molten ash and having a lower molten ash content than the mixture yielded by the combusting step; and d) cooling the warm flue gas with cold gas, to yield a mixture containing cool flue gas and non-molten ash and having a lower molten ash content than the mixture yielded by the transferring step, further comprising scrubbing NOx from the flue gas.

14. The method of claim 13, further comprising reuse of the non-molten ash as a fertilizer, a land filling material, or a component of a phosphatic cement.

15. The method of claim 13, further comprising contacting the cool flue gas with a non-dry cereal processing product, to yield a dried cereal processing product.

16. The method of claim 15, wherein the non-dry cereal processing product is fiber.

* * * * *

UNITED STATES PATENT AND TRADEMARK OFFICE

CERTIFICATE OF CORRECTION

PATENT NO. : 8,220,400 B2
APPLICATION NO. : 12/173247
DATED : July 17, 2012
INVENTOR(S) : Ganga et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 885 days.

Signed and Sealed this
Sixteenth Day of October, 2012

David J. Kappos

David J. Kappos
*Director of the United States Patent and Trademark Office*